US005981155A

United States Patent [19]

Vercruysse et al.

[11] Patent Number: 5,981,155

[45] **Date of Patent: *Nov. 9, 1999**

[54] SILVER HALIDE COLOR PHOTOGRAPHIC FILM ELEMENT HAVING A THERMOPLASTIC SUPPORT CAPABLE OF BEING MARKED BY MEANS OF A LASER

[75] Inventors: Geert Vercruysse, Kluisbergen; Jean Burtin, Mol, both of Belgium

[73] Assignee: AGFA-Gervaert, N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/772,745

[22] Filed: Dec. 23, 1996

[30] Foreign Application Priority Data

Dec. 27, 1995 [EP] European Pat. Off. ..... 95203633

[51] Int. Cl.[6] ..... G03C 1/91; G03C 1/815; G03C 1/83; G03C 11/02

[52] U.S. Cl. ..... 430/507; 430/363; 430/512; 430/523; 430/533; 430/535; 430/536; 430/539; 430/551; 430/952; 430/964

[58] Field of Search ..... 430/363, 507, 430/512, 523, 539, 952, 551, 533, 535, 536, 964

[56] References Cited

U.S. PATENT DOCUMENTS

| | | | |
|---|---|---|---|
| 4,132,552 | 1/1979 | Van Paesschen et al. | 430/535 |
| 4,770,984 | 9/1988 | Ailliet et al. | 430/507 |
| 5,071,736 | 12/1991 | Ikenoue et al. | 430/539 |
| 5,081,008 | 1/1992 | Deguchi | 430/507 |
| 5,288,715 | 2/1994 | Machell | 430/523 |
| 5,367,348 | 11/1994 | Nachmanson | 352/90 |
| 5,385,815 | 1/1995 | Schofield et al. | 430/512 |
| 5,593,818 | 1/1997 | Kawamoto | 430/507 |

*Primary Examiner*—Richard L. Schilling
*Attorney, Agent, or Firm*—Breiner & Breiner

[57] ABSTRACT

A silver halide color photographic film element and more particularly a color motion picture projection film element is provided comprising a transparent thermoplastic film support having a subbing layer unit, coated thereon at least one color forming hydrophilic layer and protective layer, characterized in that at least said subbing layer unit comprises at least one light-stabilizer, preferably absorbing ultraviolet radiation, and at least one chemical compound having reducing properties.

9 Claims, No Drawings

SILVER HALIDE COLOR PHOTOGRAPHIC FILM ELEMENT HAVING A THERMOPLASTIC SUPPORT CAPABLE OF BEING MARKED BY MEANS OF A LASER

FIELD OF THE INVENTION

The present invention relates to silver halide color photographic film elements having a thermoplastic support that are capable of being marked by means of a laser.

BACKGROUND OF THE INVENTION

Well-known transparent film supports used for silver halide photographic projection film elements or photographic film sheets to be examined as for e.g. color print film applications, can be e.g. cellulose triacetate, a polyester like a polyalkylene terephthalate or naphthalate e.g. polyethylene terephthalate or polyethylene napthalate, or polycarbonate.

As is further well-known, marking of such elements, before or after exposure to heat or radiation can be performed by means of mechanical or chemical methods, by heat or radiation, wherein said technique of radiation may be performed by means of a laser beam, travelling over the zone of film that should be marked.

Marks added to a photographic film element may be e.g. graphic elements, characters, bar codes or text.

Conventional chemical methods often make use of a technique wherein the surface of the film is initially coated with a topcoat afterlayer, which is sensitive or made sensitive to marking techniques by radiation, heat, etc. and wherein after etching the marked zones, which behave differently from the non-marked ones, a washing process cleans up the film element.

As is clear from this presentation huge amounts of chemicals are required and as a consequence this inevitably causes environmental load. Moreover chemical methods are rather complicated, as more steps are required, and as a consequence the said chemical methods are penalised by the slowness of the treatment, the need to establish artwork and the need to use plates of very high quality in order to get sharp marks. Further aspects should not be neglected as there are: its sensitivity to the accuracy with which various parameters should be adjusted such as the relief and the pressure of the said plates, the problems of choosing reagents and of irregularities in adhesion and in consistency of the protective layer, the need to take into account the sensitivity and the defects of the element to be marked, the slowness and the instability of the mechanical contact between the film element and the plate.

To summarize: chemical marking methods are much more complicated than e.g. laser engraving methods. By means of a laser beam of a high energy laser, travelling along a determined path corresponding to the inscriptions to be formed on the print film element, the silver halide photographic emulsion present in the layer(s) coated onto the support, becomes ablated locally.

In the particular application of laser subtitling methods of color print films, the quality of the result depends on the nature of the emulsion(s) and on the background density of the images on which the subtitles are to be etched. Working parameters, in particular the power of the laser beam radiation applied to the film and the displacement speed of the laser beam, are determining the sharpness of the subtitles to a large extent.

In said laser subtitling methods the power, the exposure time and the wavelength are selected so as to destroy the photographic image forming emulsion elements completely at points where the laser beam strikes the film. Due to the non-uniform release of gelatinous residues, gelatin present as a main protective hydrophilic colloid in the coated photographic layers, or to the damage of the support and as a result thereof leaving dark spots and coloured spots, an unquiet and unpleasant enlarged view is projected on the screen in the cinema.

A method and apparatus for subtitling color multilayer motion pictures or photographic plates by means of continuous or broken lines with a laser have been described in EP-A 0 201 391.

Another method and apparatus makes use of a mask to produce subtitles and has been described in EP-A 0 282 611. Further EP-A 0 464 270 describes the application of a protective layer over at least portions of a film or tape, whereupon characters should be written by means of a laser beam.

An advanced environmental friendly system inscribes textures from a PC through the support side of the film by means of a laser and has been described in DE 4 109 545: a specific advantage herein is that no chemicals are used and that there is no waste water at the end of the subtitling cycle.

An optimised method of subtitling motion pictures by laser beam travelling, directly engraving a film element, has recently been disclosed in U.S. Pat. No. 5,367,348. Said method essentially comprises the steps of travelling the laser beam over the film at a speed of displacement V lying in the range from about 1 to about 200 cm/s with a power of the laser P lying in the range of about 100 mW to about 20 W, in order to have a ratio V/P lying in the range from 10 to 30, followed by a washing step in order to remove particles that have been heated and disclocated from the zones of the film that have previously been marked by the low power laser beam. As has been disclosed in the said US-Patent the method is well adapted to subtitle motion picture films on a support constituted by a cellulose derivative such as cellulose triacetate, but is equally applicable to film supports based on a thermoplastic polymer material, such as polyester. However if use is made of a transparent polyester support such as e.g. polyethylene terephthalate, it is not possible to obtain zones without undesired spots, resulting in disturbing optical failures. Moreover lowering of the power of the laser results in grayish or slightly yellow coloured zones.

OBJECTS OF THE INVENTION

It is an object of this invention to provide a silver halide color photographic film element coated on a transparent thermoplastic support showing no disturbing optical failure after marking by means of a laser beam.

Particularly it is an object of this invention to provide a color photographic motion picture projection film element (print film element) coated on a transparent thermoplastic support showing no disturbing optical failure after subtitling by means of a laser beam.

SUMMARY OF THE INVENTION

In order to reach the objects of this invention a silver halide color photographic film element is provided, comprising a transparent thermoplastic film support having a subbing layer unit, coated thereon at least one color forming hydrophilic layer and protective layer, characterised in that at least said subbing layer unit comprises at least one light-stabilizer, preferably absorbing ultraviolet radiation, and at least one chemical compound having reducing properties. Said reducing properties are defined in such a way that the sum of its polarographically determined anodic and cathodic potentials is positive.

More particularly a color motion picture projection film element, a so called color positive print film element is provided, comprising a transparent polyester film support having a subbing layer unit, coated thereon in succession, a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an antistress layer, characterized in that at least said subbing layer unit comprises a chemical compound having reducing properties as defined above and/or a light-stabilizer, preferably absorbing ultraviolet radiation.

DETAILED DESCRIPTION OF THE INVENTION

As described hereinbefore the problem is particularly encountered with photographic film elements having thermoplastic supports with a polyester resin composition. Thermoplastic polyesters are substantially composed of linear saturated polyester. Preferred are homopolymers or copolymers having one recurring unit or at least two different recurring units such as polyalkylene terephthalate or polyalkylene naphthalate.

Typical examples are butylene terephthalate, ethylene terephthalate, butylene naphthalene dicarboxylate and ethylene naphthalene dicarboxylate, or mixtures of these. Examples of the homopolymers are polybutylene terephthalate, polyethylene terephthalate, polybutylene napthalene dicarboxylate, polyethylene napthalene dicarboxylate and mixtures thereof.

As is well-know from coating techniques applied to polyester supports it is preferred to provide the transparent polyester film support with a primer coating or a subbing layer before the application of further silver halide photographic emulsion layers. An interesting primer coating for application between e.g. a polyethylene terephthalate support and the said hydrophilic layers has been described e.g. in U.S. Pat. No. 4,132,552. Said primer coating, also called "subbing layer" is substantially composed of at least one hydrophobic layer directly contacting the transparant film support and at least one hydrophilic layer coated thereupon. The said subbing layer comprising at least one hydrophobic polymer together with the adjacent hydrophilic layer coated thereupon forms the "subbing layer unit" as set forth in the statement of this invention. Preferred hydrophobic polymers used as subbing layers are styrene-butadiene copolymers, vinylidene chloride copolymers, water-soluble polyesters and polyacrylic esters. From these hydrophobic polymers styrene-butadiene copolymers and vinylidene chloride copolymers are the most preferred. However it has been established that, according to this invention, styrene-butadiene copolymers are the most preferred in order to find a solution for the problem of getting laser marked zones on the film showing the fewest optical failures.

The hydrophilic layer coated adjacent to the subbing layer may be in the form of an aqueous dispersion e.g. a latex, optionally containing a cross-linking agent, a swelling agent, a matting agent or an antistatic agent. Examples of the cross-linking agent include triazine compounds as described e.g. in U.S. Pat. Nos. 3,325,287; 3,288,775 and 3,549,377; dialdehyde compounds as described in U.S. Pat. Nos. 3,291,624 and 3,232,764; epoxy compounds as described in U.S. Pat. No. 3,091,537; vinyl compounds described in U.S. Pat. No. 3,642,486; aziride compounds described in U.S. Pat. No. 3,392,024; ethylene-imine compounds described in U.S. Pat. No. 3,549,378 and methylol compounds. Combinations of vinyl sulphonyl compounds and triazine compounds may be useful and particularly the combination set forth in U.S. Pat. No. 4,680,257, wherein monochlorotriazine derivatives are preferred. According to the present invention the said hydrophilic colloid layer (and the other hydrophilic layers of the material) is(are) hardened with a vinyl sulphonyl hardener and/or with a triazine hardener.

As a swelling agent present in the "subbing layer unit" hydrophilic colloids such as dextran, polyacrylamide, polyvinylalcohol and polyvinyl pyrrolidone may be used, but particularly preferred is gelatin, optionally in combination with at least one of the other hydrophilic colloids cited. Preferably hydrophilic layers are gelatinous layers. The gelatin used therein can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Gelatin derivatives may be useful. Said derivatives have e.g. been described in U.S. Pat. Nos. 4,978,607; 5,378,598; 5,395,748 and 5,439,791 and in EP-A's 0 628 860 and 0 666 498.

As a matting agent present in the "subbing layer unit" use can be made of fine particles of organic compounds such as polymethyl methacrylate homopolymer, copolymer of methyl methacrylate with acrylic acid, starch and/or fine particles of inorganic compounds such as colloidal silica, synthetic clay and titanium dioxide.

As an antistatic agent present in the "subbing layer unit" use can be made of metal oxides, as described, e.g., in U.S. Pat. Nos. 4,394,441 and 5,439,785; of conductive polymers, as described e.g. in U.S. Pat. Nos. 3,437,484 and 4,898,808; of fluoro-substuted compounds as described e.g. in U.S. Pat. Nos. 4,407,937 and 4,366,238 or a combination thereof.

According to this invention at least said "subbing layer unit" defined above comprises a chemical compound having reducing properties and/or a light-stabilizing agent, also called light-stabilizer, absorbing ultraviolet radiation. Both types of compounds are mentioned as they compensate for or neutralize both an oxidation reaction which takes place as a pure thermal process at a locally elevated temperature or with the assistance of (laser) light respectively. In a preferred embodiment both types of compounds are coated in the hydrophilic layer of the "subbing layer unit", coated adjacent to the hydrophobic subbing layer which is in direct adhesive contact with the support. The film element according to the present invention thus preferably comprises said light-stabilizer and said chemical compound having reducing properties in the said hydrophilic colloid layer: the other hydrophilic layers may simultaneously contain one or more light-stabilizer(s) (which may e.g. also be present in the blue-sensitive layer) and one or more chemical compound(s) having reducing properties (which is preferably not present in light-sensitive emulsion layers comprising silver halide crystals, as fog and instability may form a problem) or may contain one of more light-stabilizer or one or more chemical compound(s) having reducing properties.

Reducing properties of the corresponding chemical compound having reducing properties are derived from the sum of its polarographically determined anodic and cathodic potentials which should be positive.

An overview of such compounds is given e.g. in "Plastic Additives Handbook", 3rd Edition, 1990, Ed. by R. Gächter and H. Müller in Chapter 1, wherein antioxidants have been described, and particularly in Chapter 12, wherein flame retardants have been described. Another reference is found in "Ullmann's Encyclopedia of Industrial Chemistry", Vol. A 20, p. 459.

To retard the thermal oxidation addition of anti-oxidants is the most commonly used method of stabilization. Especially preventive oxidants, also called secondary antioxidants, that are responsible for the destruction of e.g. oxygen radicals, hydroxyl-radicals and peroxy radicals generated rapidly in the presence of a sufficient amount of oxygen at high temperatures, are particularly preferred.

Phosphites having the general formula $O{=}P(OR)_3$ with R being a substituted or unsubstituted alkyl or aryl group are the most well-known typical representatives in the class of hydroperoxide decomposers, as well as organic sulfides having the general formula R—S—R. With respect to having a negligible influence on color stability of the environment wherein the antioxidants are coated, before and after laser marking, sterically hindered phenols are very useful compounds.

It is clear that the antioxidants should not decompose during different thermal attacks of a polymer. Nevertheless at temperatures of up to 300° C. and more parts of the oxidants are consumed as a consequence of its protective function. Moreover it is important to match the required amounts of antioxidants thereupon.

Specific classes of antioxidants are alkylphenols, hydroxyphenylpropionates, hydroxybenzyl compounds, alkylidene bisphenols, secondary aromatic amines, thiobisphenols, aminophenols, thioethers, phosphites and phosphonites, sterically hindered amines, etc. Said products are sold under well-known trade names as e.g. AGE RITE and VANOW, both from R.T. Vanderbilt Co., Norwalk, USA; ANOX from Ente Nazionale Idrocarburi, Rome, Italy; AO from Song Woun Ltd., Suweon, Korea; CAO from Ashland Chemical Co., Columbus, USA; CARSTAB from Morton Thiokol, Cincinnati, USA; CYANOX from American Cyanamid Co., Wayne, USA; ETHANOX from Ethyl Corporation, Baton Rouge, USA; GOOD-RITE from B.F. Goodrich Co., Cleveland, USA; HOSTANOX from HOECHST, Frankfurt, Germany; IONOL and IONOX from Shell Nederland Chemie BV, Den Haag, The Netherlands; IRGAFOS and IRGANOX from Ciba Geigy AG, Basel, Switzerland; NONOX, TOPANOL and NEGONOX from ICI, London, GB; PERKANOX and PHOSCLERE from Akzo Chemicals Nederland NV, Amsterdam, The Netherlands; SAMILIZER and ANTIGENE from Sumimoto Chemical Co., Ltd., Osaka, Japan; SANTONOX, SANTOWHITE, SANTOFLEX, SANTICIZER and FLECTOL from Monsanto Europe SA, Brussels, Belgium; VULKANOX from Bayer AG, Leverkusen, Germany, etc., without however being limited thereto.

From the patent literature, well-known antioxidants have been described, e.g., in U.S. Pat. No. 5,427,997 and in DE 19502083.

More particularly from said chemical compounds acting as reducing or antioxidizing agents the following chemical compounds are preferred in order to reach the objects of our invention:

a phosphate like compound (I.1)

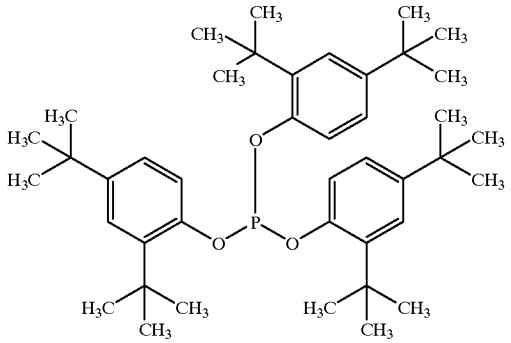

an aminophenol like compound (I.2)

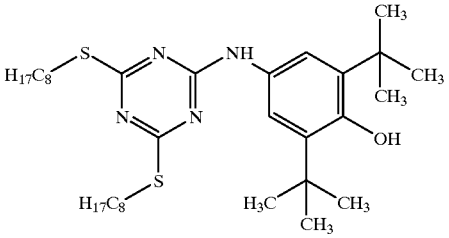

an alkylphenol like compound (I.3)

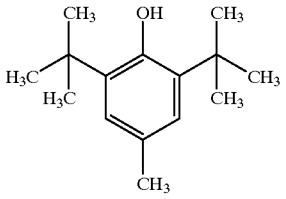

a di-ester of di-t-butylphenol like compound (I.4)

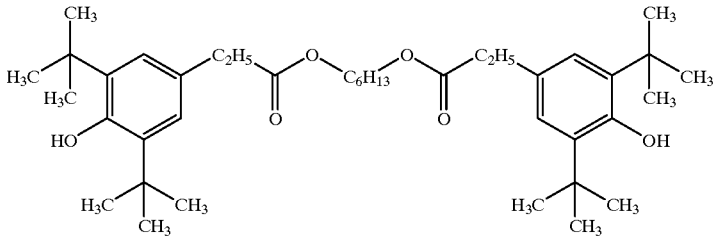

a 2,5-dialkylester substituted hydroquinone like compound (I.5)

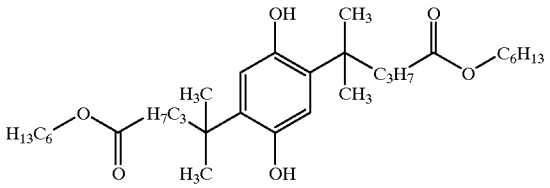

A further type of useful compounds in order to reach the objects of this invention is a so-called "flame retarding" agent.

If the layer unit adjacent to the thermoplastic support comprises one or more flame retarding agents, its action is based on the formation of a "microshield" upon the support in order to separate the combustible materials from oxygen, necessary for the combustion process, which process is accelerated by heat, generated e.g. by laser marking.

The surface of the support is thus cooled, smaller amounts of pyrolysis gases are evolved, the oxygen necessary for the combustion process is excluded to a certain extent and heat transfer is impeded. Typical useful compounds to reach that goal are phosphorous compounds. The range of effectively working products containing phosphor is extremely versatile and extends over several oxidation states: phosphines; phosphine oxides, phosphonium compounds, phosphonates, elemental red phosphor, phosphites and phosphates. Phosphorous compounds containing halogen, particularly bromine, have an increased effectiveness as a flame retardant.

The effectiveness of flame retardants containing halogen atoms increases in the order from fluorine to iodine. As the C—F bond in such organic compounds is too strong and as the C—I bond is too loose, compounds containing F and/or I are excluded. Compounds containing bromine are preferred in comparison with those containing chlorine.

Typical classes of brominated flame retardants are (a) compounds with two benzene rings such as e.g. decabromodiphenyl ether, hexabromodiphenoxy ethane etc.;

(b) tetrabromophthalic anhydride and derivatives like e.g. tetrabromophthalate diols and polyethers or ethylene bis (tetrabromophthalimide);

(c) tetrabromobisphenol A (TBBA) and derivatives like e.g. TBBA-based epoxy resin, TBBA-carbonate oligomer, TBBA-bis(allyl ether) etc.;

(d) oligomeric and polymeric flame retardants like e.g. poly(pentabromobenzyl acrylate), poly (dibromophenylene ether) or brominated polystyrene etc.;

(e) aliphatic brominated compounds like e.g. hexabromocyclododecane; ethylene bis(dibromonorbornane-dicarboximide); dibromoethyl dibromocyclohexane and dibromoneopentyl glycol etc.

Typical classes of chlorinated flame retardants are cycloaliphatic chlorinated flame retardants like "dechlorane plus" and "HET-acid" and its anhydride. Aromatic chlorinated compounds are not useful due to their limited flame retardancy.

Additions of antimony trioxide to the previously mentioned organic compounds produces a synergistic effect in flame retardant action, thanks to the intermediary generated SbOCl.

Further the list of useful inorganic compounds is rather limited: aluminum hydroxide and boron containing compounds.

Specific flame retardant products sold under well-known trade names are e.g. SAYTEX from Ethyl Corporation, Baton Rouge, USA; EXOLIT from HOECHST, Frankfurt, Germany; REOFOS from Ciba Geigy Industrial Chemicals, Manchester, GB; CERECLOR from ICI, Cheshire, GB; PHOSFLEX from Akzo Chemicals Nederland NV, Amsterdam, The Netherlands; PHOS-CHEK from Monsanto Europe SA, Brussels, Belgium; DISFLAMOLL from Bayer AG, Leverkusen, Germany, FIREBRAKE from U.S. Borax & Chemical Corp., Los Angeles, USA; IXOL from Kali-Chemie AG, Hannover, Germany; SANDOFLAM from Sandoz AG, Basel, Switzerland; etc., without however being limited thereto.

From the patent literature, especially phosphor containing compounds are preferred as has been described e.g. in U.S. Pat. No. 5,104,450 (arylene-bis(diaryl phosphates)), and in U.S. Pat. Nos. 5,219,510 and 5,288,715 (non-volatile phosphoric acid ester). Addition of antimony oxide or antimony-containing flame retardant aid has been disclosed in U.S. Pat. No. 4,666,965, wherein bromine-containing polymeric flame retarders having aromatic rings have further been disclosed; and EP-A 0 485 181 respectively.

Flame retarders have also been described in U.S. Pat. Nos. 5,071,912; 5,076,970; 5,081,176; 5,135,541; 5,218,021; 5,227,416; 5,238,982; 5,246,782; 5,326,805; 5,342,656; 5,346,938; 5,374,637; 5,389,712; 5,409,976 and 5,382,474, and in WO's 9411425; 9411439 and 9419382.

Light-stabilizing agents, and more particularly those absorbing ultraviolet radiation for linear or thermoplastic polyesters like polyethylene or polybutylene terephthalate, show an absorption spectrum, which going from larger to smaller wavelengths begins at 360 nm, significantly increases below 320 nm and becomes most pronounced below 300 nm.

Suitable light-stabilizing agents absorbing ultraviolet radiation are selected from the group of organic compounds consisting of 2-hydroxybenzophenones and 2-hydroxophenyl benzotriazoles, sterically hindered amines (nitroxyl radicals as effectively absorbing agent) and organic nickel compounds (like n-butylamine-nickel-2,2'-thio-bis-(4-t-octylphenolate))

Well-known additives thereto are salicylates, cinnamate derivatives, resorcinol monobenzoates, oxanilides and p-hydroxy-benzoates (like 3,5-di-tert.-butyl-4-hydroxybenzoic acid 2,4-di-tert.-butyl phenylester or 2-hydroxy-4-dodecyloxybenzophenone). Benzotriazole compounds are considered to act as quenchers, in the sense that they efficiently deactivate excited states. UV-absorbers are further very effective decomposers of hydroperoxides and scavengers of free radicals.

For linear polyesters benzotriazole type UV absorbers are generally chosen because they inhibit low initial color and good color stability. Recently the effectiveness of sterically hindered amines has been taken in consideration as opening new horizons.

Specific products sold under well-known trade names are e.g. HOSTAVIN from HOECHST, Frankfurt, Germany; IRGASTAB, CHIMASSORB and TINUVIN from Ciba Geigy, Basel, Switzerland; UVINIL and SICOSTAB from BASF, Ludwigshafen, Germany; UC-CHEK AM from Ferro Corp., Cleveland, USA; UV-ABSORBER BAYER from Bayer AG, Leverkusen, Germany; SANDUVOR from Sandoz AG, Basel, Switzerland; GOODRITE UV, from BF Goodrich, Cleveland, USA; CYASORB UV from American Cyanamid Co., Wayne, USA; EASTMAN INHIBITOR from Eastman Chemical Products Inc., Kingsport, USA; RYLEX from Du Pont de Nemours, WILMINGTON, USA; SALOL from Dow Chemical Co., Midland, USA; etc., without however being limited thereto.

Especially preferred concentrations of light stabilizers are in the range from 0.05 to 2% by weight with respect to the layer or material to be protected.

Suitable UV-absorbers known from patent literature are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71 and U.S. Pat. No. 3,503,330, cinnamic ester compounds as described in U.S. Pat. Nos. 3,705,805 and 3,707,375, butadiene compounds as described in U.S. Pat. No. 4,045,229, butadiene compounds having a pyrrolidine nucleus as has been disclosed in RD No. 18032 (April 1979), p. 139–140; benzoxazole compounds as described in U.S. Pat. No. 3,700,455 and polymeric stilbene-triazine compounds as in U.S. Pat. No. 3,615,547.

More particularly from said chemical compounds acting as UV-absorbers the following chemical compounds were preferred in order to reach the objects of our invention:

2-OH-4-methoxy-benzophenone (compound II.1)

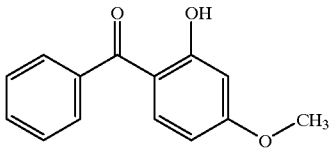

2,4-di-OH-benzophenone (compound II.2)

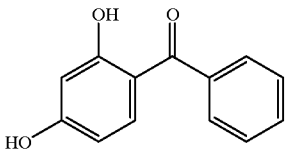

As set forth hereinbefore at least said subbing layer unit comprises a chemical compound having reducing properties and/or a light-stabilizing chemical compound absorbing ultraviolet radiation.

Other layers in the layer arrangement of silver halide photographic film elements according to this invention carrying a reducing agent and/or a light-stabilizing agent as set forth hereinbefore may be (a) radiation sensitive silver halide emulsion layers, the proviso that these agent(s) has(have) no or a neglectable influence on sensitometric characteristics,
(b) intermediate layers as e.g. layers between the "subbing unit" and the first light-sensitive silver halide emulsion layer; between two light-sensitive silver halide emulsion layers, between a light-sensitive layer and a protective overcoat layer (e.g. a protective antistress layer)
(c) protective layer(s)
(d) overcoat layer(s)
(e) afterlayer(s)
(f) one or more backing layer(s).

In the case of hydrophilic colloid layers gelatin is the most preferred colloid.

According to this invention color photographic motion picture projection film elements as multilayer color print film elements intended for making color release prints are subtitled after color processing. Said elements basically consist of a transparent polyester film support carrying in the given order a blue-sensitive silver halide emulsion layer, a red-sensitized silver halide emulsion layer, and a green-sensitized silver halide emulsion layer. Between the emulsion layers intermediate layers of a hydrophilic colloid, mostly gelatin, are provided for better color separation. The side of the transparent film support opposite to that carrying the emulsion layers is coated with a carbon black antihalation back layer. A carbon black antihalation back layer indeed provides excellent halation protection and has excellent antistatic properties. Unfortunately, carbon black has the disadvantage of getting loose easily from the antihalation back layer, thus creating dust that smears the photographic elements and exerts a disturbing influence during the image-wise exposure thereof. Moreover, the removal of the carbon black antihalation back layer, which should take place before the color development can be started, is rather cumbersome. To avoid the disadvantages concurrent with the use of carbon black antihalation back layers in color photographic motion picture projection film elements, one can make use in a more preferred embodiment of antihalation dyes in these elements in the same way as it is done in other types of photographic elements, in which one or several antihalation dyes having light absorption spectra depending on the spectral sensitivity of the light-sensitive layers are employed.

Attempts in color photographic motion picture projection film elements in order to use a combination of antihalation dyes, which can absorb light of the entire visible spectral range, has been accomplished by providing a color photographic motion picture projection film element comprising a transparent film support and coated thereon in succession, a blue-sensitive silver halide emulsion layer comprising a yellow-forming coupler, an intermediate layer, a red-sensitized silver halide emulsion layer comprising a cyan-forming coupler, an intermediate layer, a green-sensitized silver halide emulsion layer comprising a magenta-forming coupler, and an antistress layer, characterized in that between said support and said blue-sensitive silver halide emulsion layer a yellow antihalation undercoat is provided, which comprises at least one yellow non-diffusing dye that absorbs blue light and is removable and/or decolorizable in a processing bath and that between said blue-sensitive silver halide emulsion layer and said red-sensitized silver halide emulsion layer a bluish antihalation intermediate layer is provided, which comprises at least one blue non-diffusing dye that absorbs red light and is removable and/or decolorizable in a processing bath as has been disclosed in EP-Specification 0 252 550 and the corresponding U.S. Pat. No. 4,770,984, which are incorporated herein by reference.

Suitable amounts of both the ultraviolet light-absorbing compound and the reducing agent are comprised between 25 and 250 mg/m$^2$ and more preferably between 50 and 150 mg/m$^2$.

According to a preferred embodiment according to this invention the said yellow antihalation undercoat contains said at least one reducing agent and at least one light-stabilizer, preferably in amounts as set forth hereinbefore. Dispersions of said reducing agent and of said light-stabilizer in this hydrophilic yellow antihalation layer are preferably prepared in the presence of oil-formers as e.g. tricresyl-phosphate, dibutylphthalate, diethyllaurate, myristol, di-pentylphenol and the like. The type and the amounts of oil-former used in the dispersion and coated therefrom in the "subbing layer unit", preferably in the hydrophilic uppermost layer thereof, are decisive for the adhesion characteristics of "subbing layer unit" and support.

As set forth hereinbefore bromine-containing agents are much better flame-retardant or flame-resistant agents than chloride-containing agents. So it can be understood that the use of silver halide emulsions rich in chloride, leads to a much larger extent to a laser marking optical failure than the use of silver bromide or silver bromoiodide emulsions, used preferably in e.g. color negative films, microfilms, X-ray films and the like. Materials in which silver halide emulsions rich in chloride are used as e.g. color print films, films for graphic applications and for diffusion transfer are expected to be more sensitive to the phenomenon of flame-sensitivity, which causes problems when laser engraving methods are applied to mark such films before processing. It is clear however that in the particular case of subtitling color print films according to this invention the laser engraving method is applied after processing. Nevertheless the presence of residual chloride ions, even after thoroughly washing procedures after development, fixation and bleaching (as for color films after being color processed), engraves the problem of flame-sensitivity to a large extent. This has been proved by an experiment wherein a processed film was washed in a bath, containing an excess of an alkaline chloride salt, followed by drying and laser engraving: the processed film was much more sensitive to the known disturbing optical failures.

As has already been described in the background of this invention the power of the laser is one of the factors determining the quality of the marks, obtained by laser engraving techniques. Suitable lasers to be used, depending on the application are gas-, dye- or semiconductor lasers emitting light in the wavelength ranges from ultraviolet to infrared as well as a plasma light source. Said light sources are known as suitable light sources for recording but in order to get subtitling action a "green-blue" YAG-laser having a well-defined power and subtitling velocity, as e.g. described in U.S. Pat. No. 5,367,348 is preferred. Another laser used in the Examples hereinafter is an Ar-laser, emitting green-blue (488 nm) or, preferably, green (515 nm) light. Other lasers having a typical emission in the longer (red) wavelength region are He—Ne and Kr-lasers.

EXAMPLES

Samples of color photographic motion picture projection film elements A, B, C . . . to K were made. Each sample had a transparent film support, a subbing layer, a blue-sensitive silver halide emulsion layer comprising a yellow-forming coupler, an intermediate gelatin layer, a red-sensitized silver halide emulsion layer comprising a cyan-forming coupler, an intermediate gelatin layer, a green-sensitized silver halide emulsion layer comprising a magenta-forming coupler, and an antistress layer as has also been described in EP-Specification 0 252 550. All samples were identical except for the composition of the combination of reducing agent and light-stabilizer, as summarised in Table 1.

Element A (comparative) had a yellow antihalation undercoat between the support and the blue-sensitive emulsion layer, the yellow antihalation undercoat having a thickness of 1 $\mu$m and comprising 290 mg of a yellow dye and 0.6 g of gelatin per m$^2$.

Elements B, C . . . to K (invention) had an identical yellow antihalation undercoat as in Element A and in addition thereto the corresponding ultraviolet (UV) absorber compound in an amount of 100 mg per m$^2$ and as a reducing agent in an amount of 100 mg per m$^2$, both UV-absorber and reducing agent as summarized in Table 1.

After exposure and color processing the print film was subtitled by means of a laser having a power of 6 W, 5 W and 4 W.

The color motion picture film as well as still film pictures made therefrom were projected and evaluated visually (qualitatively) on a projection screen. For all film samples the results became better after inscription with the laser having a decreasing power (4 W better than 5 W; 5 W better than 6 W). Differences between samples were about the same as the power of the laser was decreasing, but as the global impression obtained was less noisy for a decreasing laser power, results expressed as evaluation marks obtained after examining samples engraved with a laser power of 4 W were summarized in Table 1 hereinafter.

Numbers of compounds are corresponding with those given in the detailed description.

Evaluation marks were given from 1 to 5:

1: excellent character type without noise
2: sligtly noisy, especially in overlapping parts of letters
3: noisy but still acceptable
4: noisy but unacceptable
5: very noisy, bad

TABLE 1

| Exp. No. | Reducing agent | Uv-absorber | Laser Power | Evaluation mark |
|---|---|---|---|---|
| A | No | No | 4 W | 5 |
| B | I.4 | II.1 | 4 W | 1 |
| C | I.5 | II.1 | 4 W | 3 |
| D | I.1 | II.1 | 4 W | 3 |
| E | I.2 | II.1 | 4 W | 2 |
| F | I.3 | II.1 | 4 W | 2 |
| G | I.4 | II.2 | 4 W | 1 |
| H | I.5 | II.2 | 4 W | 1 |
| I | I.1 | II.2 | 4 W | 3 |
| J | I.2 | II.2 | 4 W | 2 |
| K | I.3 | II.2 | 4 W | 2 |

As can be concluded from the evaluation marks for the different coatings summarized in Table 1 the disturbing optical failure, due to roughness on the bare support, obtained after the destructive thermic and thermo-oxidative engraving processes due to the laser subtitling method has been overcome as soon as a suitable combination of UV-absorber and reducing agent has been added to the hydrophilic yellow antihalation layer, said layer making part of the "subbing layer unit" as described hereinbefore. Especially preferred therein is the combination of reducing compound I.4 together with ultraviolet absorber II.1 or II.2, as well as the combination of reducing compound I.5 with ultraviolet absorber II.2.

All other combinations lead to improvements if compared with the comparative sample A, wherein none of both types of compounds are added.

Further experiments wherein amounts of 100 mg/m$^2$ of both an antioxidant and an ultraviolet absorbing compound were divided between the yellow antihalation layer, the blue antihalation layer and/or the protective antistress layer were showing that addition of both compounds to gelatinous intermediate or topcoat layers situated farther from the support lead to less convincing or less pronounced improvements in the quality of laser engraved characters.

We claim:

1. A silver halide photographic motion picture projection film element which upon being exposed and color processed can be marked for subtitling purposes by a laser beam, said element comprising a transparent polyethylene terephthalate film support having a subbing layer unit and coated thereon, in succession, a blue-sensitive silver halide emulsion layer comprising a yellow-forming coupler, an intermediate layer, a red-sensitized silver halide emulsion layer comprising a cyan-forming coupler, an intermediate layer, a green-sensitized silver halide emulsion layer comprising a magenta-forming coupler and an anti-stress layer, said subbing layer unit further comprising at least one light-sensitive stabilizer and at least one chemical compound having reducing properties which is an oxidant and/or a flame retarding agent selected form the group of compounds consisting of phosphites having the general formula $O{=}P(OR)_3$; organic sulfides R—S—R and sterically hindered phenols, R representing therein an alkyl or an aryl group and wherein said light-stabilizer is a benzophenone compound absorbing ultraviolet radiation, said sterically hindered phenols being selected from the group consisting of di-esters of di-t-butylphenol and 2,5-dialkylester substituted hydroquinone and said element being laser ablatable without detriment to said film element.

2. A film element according to claim 1, wherein said subbing layer unit has coated between the blue-sensitive silver halide emulsion layer and the transparent support a yellow antihalation undercoat which comprises at least one yellow non-diffusing dye that absorbs blue light and is removable and/or decolorizable in a processing bath.

3. A film element according to claim 2, wherein between said blue-sensitive silver halide emulsion layer and said red-sensitized silver halide emulsion layer a bluish antihalation intermediate layer is provided, which comprises at least one blue non-diffusing dye that absorbs red light and is removable and/or decolorizable in a processing bath.

4. A film element according to claim 1, wherein said light-stabilizing agent absorbing ultraviolet radiation is selected from the group of benzophenone compounds consisting of 2-hydroxy-4-methoxy-benzophenone and 2,4-dihydroxy-benzophenone.

5. A film element according to claim 1, wherein said subbing layer unit is substantially composed of at least one hydrophobic layer directly contacting the transparent film support and at least one hydrophilic colloid layer coated thereupon.

6. A film element according to claim 5, wherein said hydrophobic layer has a composition selected from the group consisting of vinylidene chloride and styrene/butadiene copolymers.

7. A film element according to claim 5, wherein said hydrophilic colloid layer is a gelatinous layer.

8. A film element according to claim 5, wherein said hydrophilic colloid layer is hardened with a vinyl sulphonyl hardener and/or with a triazine hardener.

9. A film element according to claim 5, wherein said hydrophilic colloid layer comprises said light-stabilizer and said chemical compound having reducing properties.

* * * * *

UNITED STATES PATENT AND TRADEMARK OFFICE

CERTIFICATE OF CORRECTION

PATENT NO. : 5,981,155

DATED : November 9, 1999

INVENTOR(S) : Geert Vercruysse et al

It is certified that error appears in the above-indentified patent and that said Letters Patent is hereby corrected as shown below:

ON THE TITLE PAGE:

Item [73] Assignee: "AGFA-Gervaert, N.V." should read -- Agfa-Gevaert, N.V. --.

Signed and Sealed this

Sixteenth Day of May, 2000

*Attest:*

Q. TODD DICKINSON

*Attesting Officer*

*Director of Patents and Trademarks*